United States Patent [19]

Abe

[11] Patent Number: 5,024,199

[45] Date of Patent: Jun. 18, 1991

[54] AIR-FUEL RATIO CONTROL SYSTEM FOR AUTOMOTIVE ENGINE

[75] Inventor: Kunihiro Abe, Tokyo, Japan

[73] Assignee: Fuji Jukogyo Kabushiki Kaisha, Tokyo, Japan

[21] Appl. No.: 414,451

[22] Filed: Sep. 29, 1989

[30] Foreign Application Priority Data

Oct. 7, 1988 [JP] Japan ..... 63-25359

[51] Int. Cl.[5] ..... F02M 51/00; F02D 41/14

[52] U.S. Cl. ..... 123/489; 364/431.05

[58] Field of Search ..... 123/440, 489, 494, 488; 364/431.05

[56] References Cited

U.S. PATENT DOCUMENTS

| | | | |
|---|---|---|---|
| 4,200,064 | 4/1980 | Engele | 123/440 |
| 4,466,410 | 8/1984 | Sakakibara et al. | 123/489 |
| 4,733,357 | 3/1988 | Abe | 123/489 |
| 4,737,914 | 4/1988 | Abe et al. | 123/489 |
| 4,829,440 | 5/1989 | Abe | 123/489 |
| 4,852,010 | 7/1989 | Amano et al. | 123/489 |
| 4,862,855 | 9/1989 | Manaka et al. | 123/489 |
| 4,901,240 | 2/1990 | Schmidt et al. | 123/440 |
| 4,913,122 | 4/1990 | Uchida et al. | 123/489 |

FOREIGN PATENT DOCUMENTS

| | | | |
|---|---|---|---|
| 0261948 | 12/1985 | Japan . | |
| 0259136 | 10/1988 | Japan | 123/489 |

*Primary Examiner*—Tony M. Argenbright
*Assistant Examiner*—Robert E. Mates
*Attorney, Agent, or Firm*—Beveridge, DeGrandi & Weilacher

[57] ABSTRACT

There is disclosed an air-fuel ratio control system for an automotive engine having a fuel injection system and an intake air quantity measurement system including an oxygen sensor, an intake air quantity sensor, and a coolant temperature sensor. The control system comprises a learning region setting element for setting a learning region in the manner of instruction for any of the learning regions of an air-fuel ratio corresponding to operational regions of any characteristic change of the injection or measurement system, a learning element for representatively learning a correction quantity of the injection system at a specified point of the regions and for learning the correction quantity of the measurement system at other points of regions in dependency on the instruction from the setting element, a basic fuel setting element for setting a basic fuel injection quantity in dependency on an engine speed, intake air quantity, and a learning value output from the learning element, and a fuel setting element for setting an actual fuel injection quantity corrected by the learning value corresponding to the operational regions.

13 Claims, 7 Drawing Sheets

FIG. 4(c)

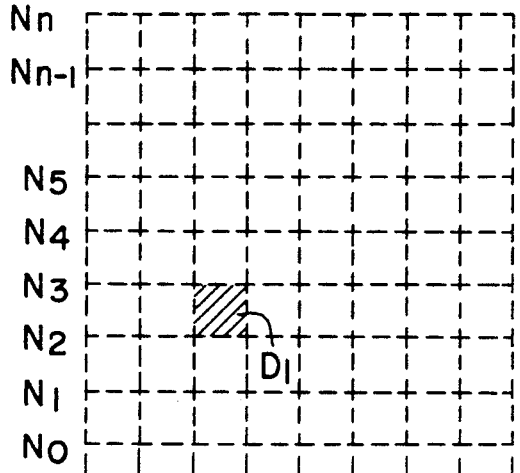
FIG. 4(a)
FIG. 4(b)
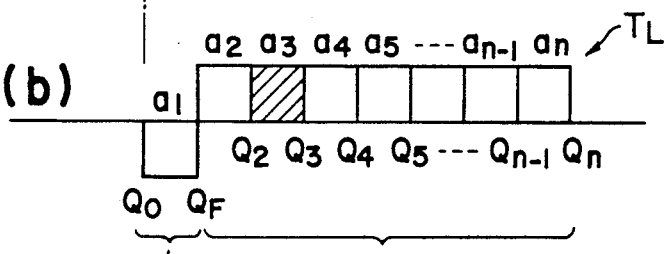
LEARNING MATRIX BY CHARACTERISTICS OF FUEL INJECTION SYSTEM
LEARNING MATRIX BY CHARACTERISTICS OF MEASUREMENT SYSTEM OF INDUCED AIR
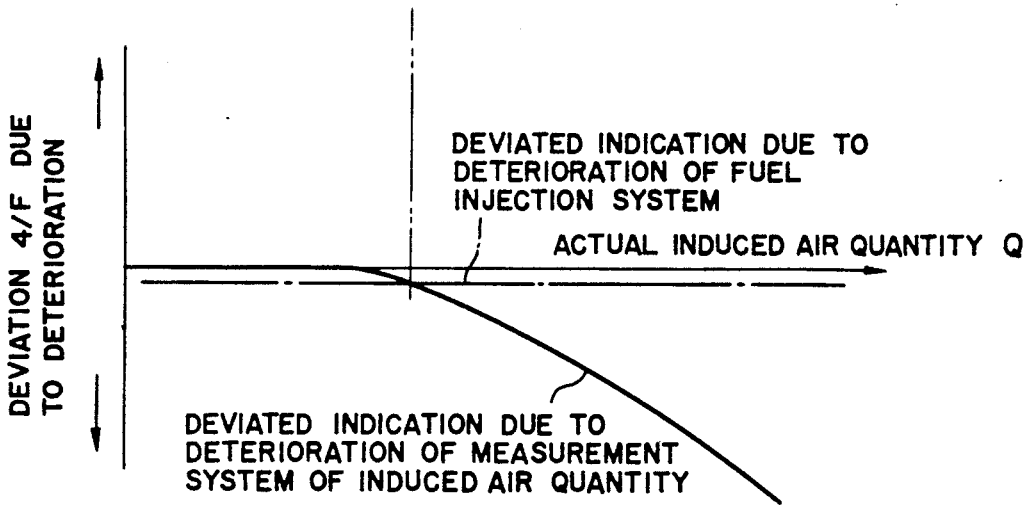
FIG. 4(c)

AIR-FUEL RATIO CONTROL SYSTEM FOR AUTOMOTIVE ENGINE

BACKGROUND OF THE INVENTION

The present invention relates to an air-fuel ratio control system for an engine having a learning control function.

An electronic control fuel injection system (EGI) generally determines an injection quantity by compensating a basic fuel injection quantity $T_P$ by various compensation factors The basic quantity $T_P$ is the injection quantity to obtain a theoretical air-fuel ratio corresponding to a suction air quantity $Q_A$ and an engine speed $S_E$ and is calculated by:

$$T=K\times Q_A/S_E$$

where K is a constant. The actual fuel injection quantity Ti is set by multiplying the basic quantity $T_P$ by various correction coefficients corresponding to various operational conditions of the engine.

The various correction coefficients include various quantities of increase correction coefficient $C_I$ for adapting the air-fuel ratio to the operational condition at the time, an acceleration/deceleration correction coefficient $K_S$, an air-fuel ratio feedback correction coefficient $\alpha$ for the theoretical air-fuel ratio, and a voltage correction coefficient $T_s$. The air-fuel ratio is controlled by the actual fuel injection quantity $T_i$ set by various correction coefficients. Namely, the quantity $T_i$ is set by;

$$T_I=T_P\times\alpha\times(C_I+K_S)+T_S$$

In order to keep the air-fuel ratio under the theoretical ratio, an exhaust sensor such as an oxygen sensor exposed in an exhaust pipe, measures oxygen density of exhaust gases and calculates an air-fuel ratio of the induced mixture. Air-fuel ratio feedback control is performed by a compensation amount in dependency on a difference between the calculated air-fuel ratio and the theoretical air-fuel ratio.

However, the air-fuel ratio feedback control requires a long time to set an actual air-fuel ratio equal to a reference air-fuel ratio if the deviation between the reference ratio and disturbance is not within predetermined limits. Furthermore, it is possible for the control of the air-fuel feedback control system to be disabled by instabilities such as overshoot or hunting of the air-fuel ratio when an operation range rapidly changes or when a control output misses the reference in dependency on factors changing with the lapse of time.

Accordingly, more precise air-fuel control is realized by learning control having a learning value of the amount of difference between the air-fuel ratios in order to increase conformity with a control value and the reference, to compensate for inferiority of individual parts or differences between the characteristics of each part, and to precisely correct the air-fuel ratio within regions in which air-fuel ratio feedback control cannot be performed. Namely, if a learning correction coefficient denotes $K_L$, the fuel injection quantity $T_i$ is calculated by the following equation;

$$T_i=T_P\times\alpha\times(C_I\times K_L\times K_S)+T_S$$

and the air-fuel ratio is controlled by the fuel injection quantity $T_i$ corrected by learning.

Such air-fuel ratio control by learning is disclosed in, for example, Japanese patent laid-open No. 60-93150 (1985). The prior art corrects an air-fuel ratio not only during the air-fuel ratio feedback control but also in the region where the air-fuel ratio feedback control is not performed. The air-fuel ratio is controlled by correcting the constant K to calculate the fundamental fuel injection quantity $T_P$ corresponding to the difference between a learning correction coefficient and an initial value only when the coefficient is renewed over the predetermined degree and has a difference against the initial value in the same direction. The coefficient is stored in a map on a random access memory (RAM) in dependency on an operational condition for the engine such as the engine speed and an engine load.

However, the map storing the learning correction coefficient requires a large memory capacity. Low learning frequencies in any region lack precision for the control because of the correction by assumption. Since the renewal of the map, i.e. the rewriting of the memory requires a longer time as the memory becomes large, the control procedure is complicated so that the convergency of the learning value deteriorates.

Furthermore, the cause depending on the air-fuel ratio mainly occurs in a measuring system for the suction air quantity such as a suction air quantity sensor and in a fuel injection system such as an injector or pressure regulator. As shown in FIG. 4(*c*), the deterioration characteristics of the change, lapse with time occurring in the measuring system are different from those in the fuel injection system. Accordingly, a miscalculation of the suction air quantity is caused by the change due to extended use of the measuring system such as the suction air quantity sensor. Furthermore, the miscalculation is different from an error of the actual fuel injection quantity caused by the fuel injection system is correspondence to the operational regions in dependency on the difference of deterioration characteristics of both system. Therefore, the deterioration of the control ability and learning accuracy is a problem because the learning value of one system conflicts with the value of the other system in the same learning region. For example, the correction learning for discrepancy of the air-fuel ratio caused by the deterioration of suction air quantity sensor is different from the correction learning for discrepancies of the air-fuel ratio caused by deterioration occurring in the injector or the pressure regulator.

SUMMARY OF THE INVENTION

An object of the present invention is to provide an air-fuel ratio controller for an engine capable of increasing the learning accuracy by eliminating conflicting learning values in the same learning region in dependency on the removal of the learning regions overlapping a plurality of the learnings, and capable of the improvement of the exhaust emission and fuel consumption by increasing the controllability in dependency on a small memory region of the learning value.

In order to achieve the above object, an air-fuel ratio controller of an engine according to the present invention comprises learning region determining means for designating a learning region in dependency on an operational region of an engine, a learning control unit for representatively learning a correction quantity of a fuel injection system at a specific region of the operational region and for learning a correction quantity value of an intake air quantity measurement system, basic fuel injection quantity setting means in dependency on an intake air quantity and a first learning value of the measurement system, and fuel injection quantity setting means for setting an actual fuel injection quantity corrected by a second learning value of the injection system corresponding to the operational region in dependency on the basic fuel injection quantity. The learning region determining means determine the learning region in dependency on a first difference quantity of an air-fuel ratio by characteristics changes of the fuel injection system and a second difference quantity of the air-fuel ratio by characteristics changes of the intake air quantity measurement system.

By the above-mentioned construction, the learning region of the learning control unit is divided by a discriminator into a first learning region of the characteristics of the injection system and a second learning region of the characteristics of the measurement system. The learning control unit representatively learns the characteristics of the injection system at the specified point in the operational region, while the unit learns the characteristics of the measurement system in other points of the operational region. Accordingly, a learning correction of the intake air quantity or the fuel injection quantity is performed in accordance with the operational region so as to control the air-fuel ratio by setting the actual fuel injection quantity.

BRIEF DESCRIPTION OF THE DRAWINGS

FIGS. 4(*a*), (*b*) and (*c*) are characteristics diagrams respectively showing a matrix for judgment, a learning value table, and deterioration characteristics of the control system;

DETAILED DESCRIPTION OF THE PREFERRED EMBODIMENTS

Figure 1:
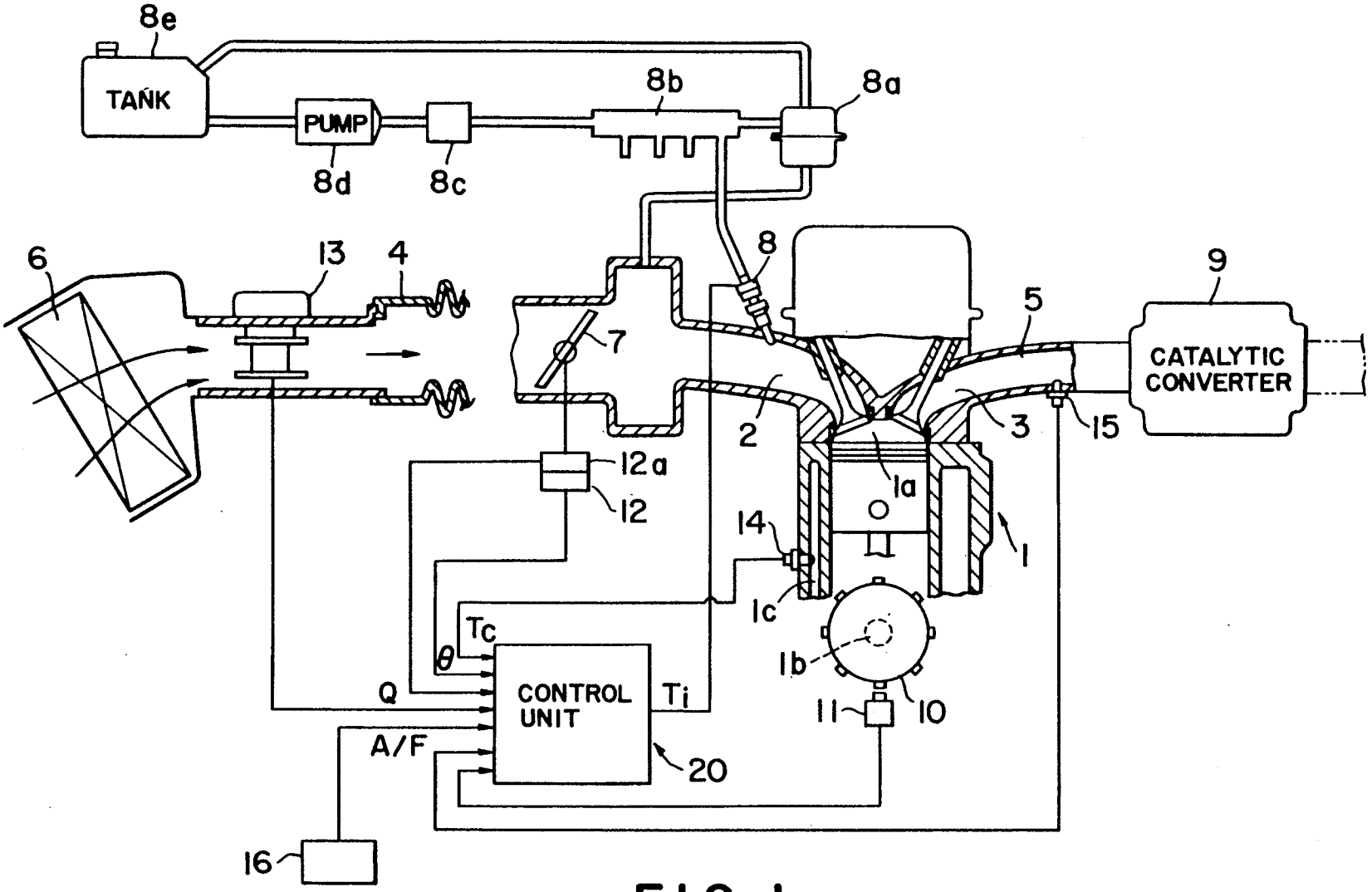
FIG. 1 is a schematic block diagram showing an engine control system with an air-fuel ratio control system according to the present invention.

Referring to FIG. 1, an engine control system is described. An engine 1 has a combustion chamber 1*a* and a crank shaft 1*b*. In each cylinder, the combustion chamber 1*a* has an intake port 2 communicated with an intake pipe 4, and an exhaust port 3 communicated with an exhaust pipe 5. An air cleaner 6 is communicated with an upstream side of the intake pipe 4. The pipe 4 has a throttle valve 7 at an intermediate position thereof An injector 8 is disposed in the upstream side of the combustion chamber 1*a*. The injector 8 is provided on each cylinder of the engine 1. A fuel injection system comprises the injector 8, a pressure regulator 8*a* for regulating a differential pressure between an air pressure in the pipe 4 and a fuel pressure, a delivery pipe 8*b* for supplying the fuel, a fuel filter 8*c* for filtering the fuel, a fuel pump 8*d* for feeding the fuel, and a fuel tank 8*e*. A catalytic converter 9 is provided in the exhaust pipe 5.

On the other hand, a crank rotor 10 is fixedly provided around the crank shaft 1*b*. A crank angle sensor 11 is provided against the outer surface of the rotor 10. A throttle position sensor 12 is provided at the throttle valve 7, and has an idle switch 12*a* for detecting an opening degree of the throttle valve 7. The intake pipe 4 has an intake air quantity sensor 13 on the downstream side of the air cleaner 6. An intake air quantity measurement system including the sensor 13 calculates an intake air quantity. A fuel injection system having the injector 8, the fuel pump 8*d*, the pressure regulator 8*a* and a control unit 20 calculates a fuel quantity according to the intake air quantity. An air-fuel mixture is supplied through the intake port 2 and induced in the combustion chamber 1*a* of the engine 1.

Furthermore, a coolant temperature sensor 14 is exposed in a coolant passage 1*c* formed in the engine 1. An exhaust gas sensor such as an oxygen sensor 15 is exposed in the exhaust pipe 5 at the upstream side of the catalytic converter 9.

A battery 16 supplies the engine control system with a power source. The sensors 11 to 15 and the control unit 20 operate the system by stepped-down and stabilized voltage from the battery 16 through a constant voltage circuit (not shown).

Figure 2:
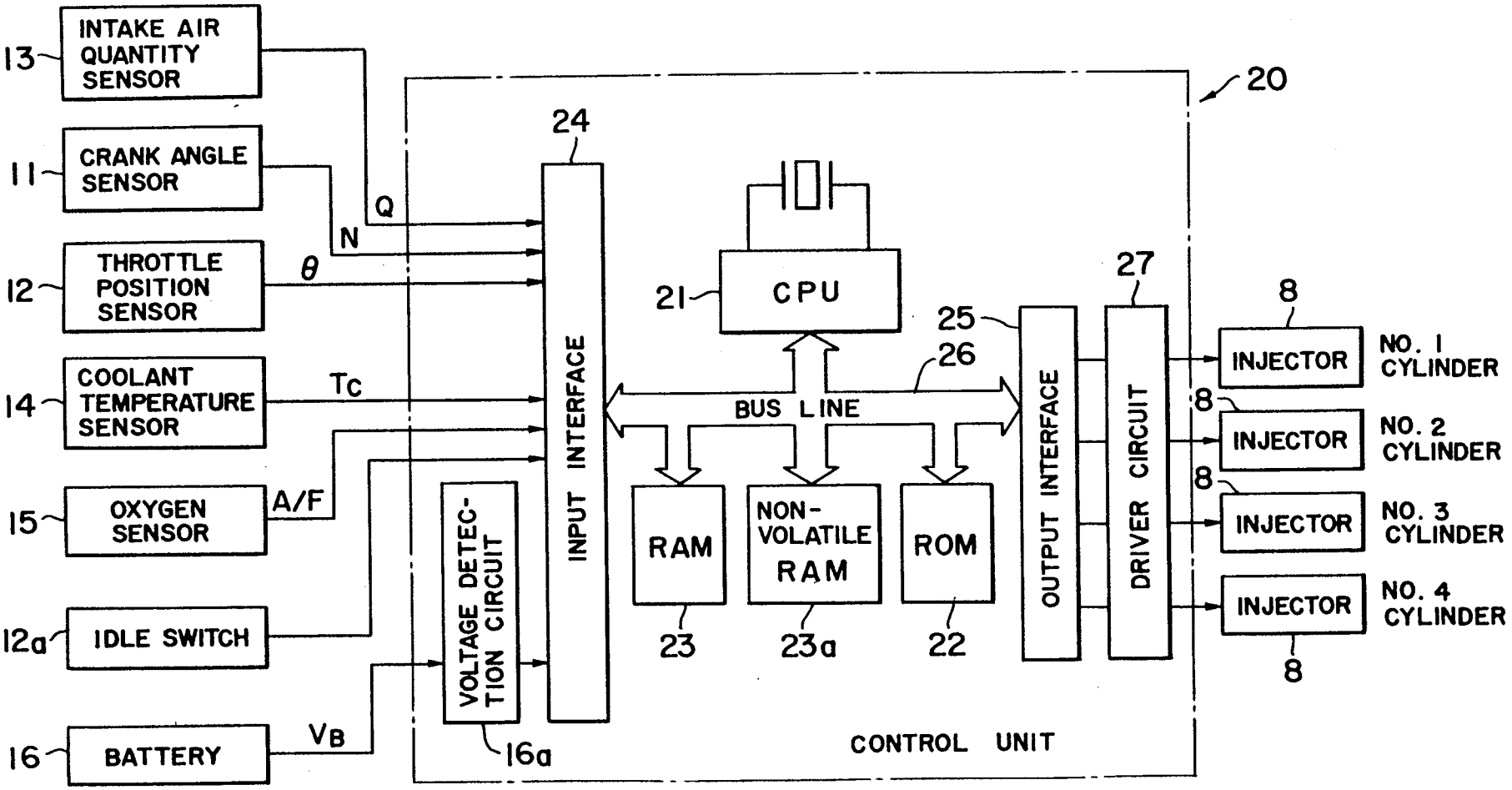
FIG. 2 is a block diagram showing the air-fuel ratio control system of the present invention.

An air-fuel control system is shown in FIG. 2. The control unit 20 comprises a central arithmetic processing unit (CPU) 21, a read only memory (ROM) 22, a random access memory (RAM) 23, a non-volatile RAM 23*a*, an input interface 24 and an output interface 25, which are interconnected each other by a bus line 26. The sensors 11 to 15 are connected to the input interface 24. The battery 16 is connected to the interface 24 through a voltage detection circuit 16*a*. The output interface 25 is connected to the injectors 8 provided on No. 1 to No. 4 cylinders, respectively, through a driver circuit 27.

The ROM 22 stores fixed data such as control programs, while the RAM 23 stores output values from several sensors 11 to 15 after processing data. The non-volatile RAM 23*a* stores a learning table $T_L$ and keeps the stored data by a backup of the battery 16 even though a starting switch for the engine is turned off.

The CPU 21 calculates an intake air quantity in dependency on an output signal from the intake air quantity sensor 13 according to the control program stored in the ROM 22. The CPU 21 further calculates a fuel injection quantity corresponding to various data stored in the RAM 23 and the non-volatile RAM 23*a*. At the same time, the CPU 21 calculates an ignition timing and outputs an instruction via the driver circuit 27 to the injectors 8.

As a result, an air-fuel mixture having the predetermined ratio is induced into the combustion chamber 1*a*. Since the oxygen sensor 15 is exposed in the exhaust pipe 5, the sensor 15 detects an oxygen density in the exhaust gas. After the reforming wave of a detection signal, the CPU 21 compares the signal with the reference voltage signal and determines whether the actual air-fuel ratio is rich or lean with respect to the reference, namely a theoretical air-fuel ratio. The RAM 23 receives via the bus line 26 and stores the determined result of "1" when rich or "0" when lean. The CPU 21 monitors the air-fuel ratio data of the mixture stored in the RAM 23 at every constant time to therefore perform an air-fuel ratio feedback correction.

Next, the operation of the controller will be explained.

Figure 3:
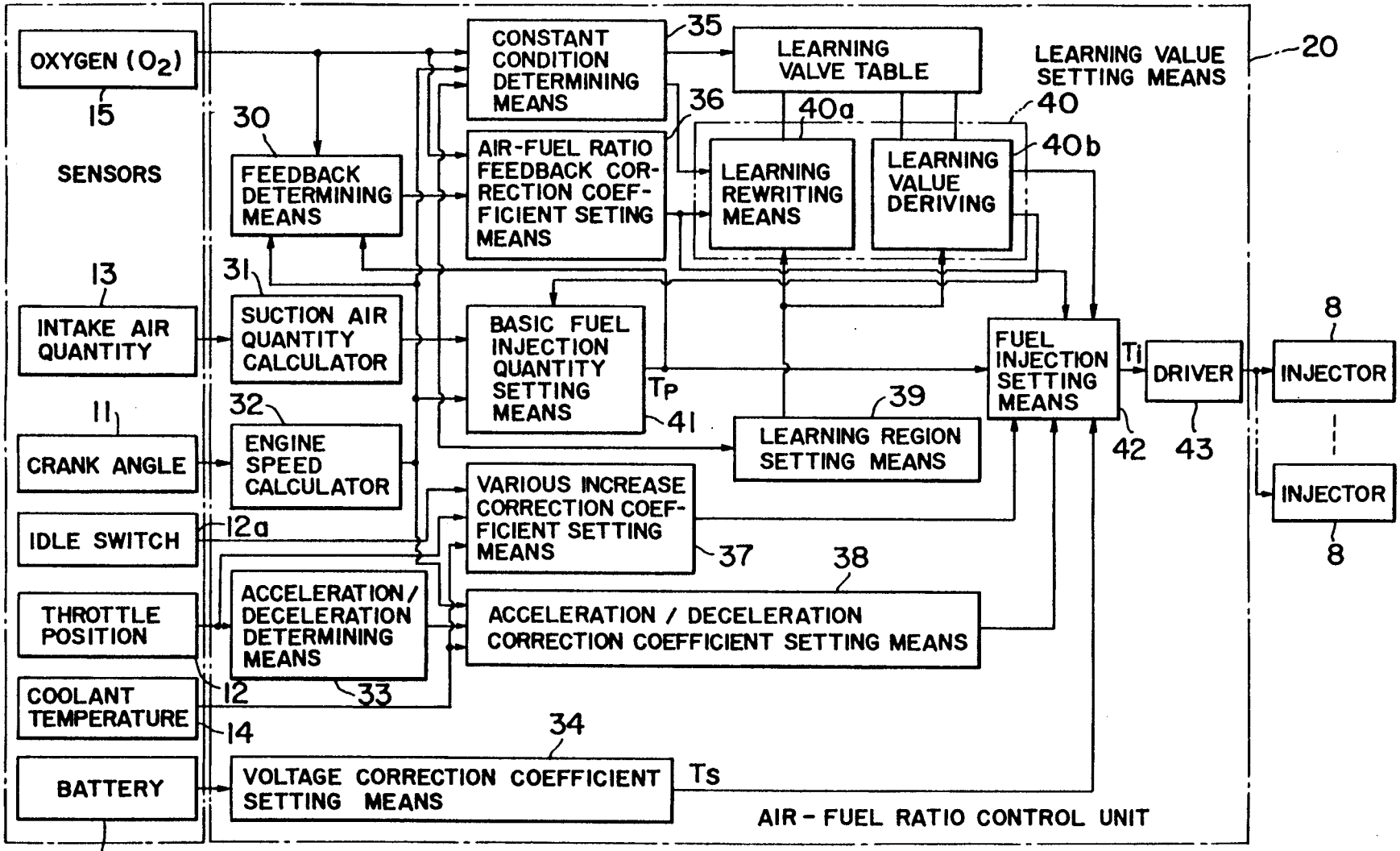
FIG. 3 is a block diagram showing a functional structure of the air-fuel ratio control system of the present invention.

As shown in FIG. 3, the air-fuel control unit 20 comprises feedback determining means 30, a suction air quantity calculator 31, an engine speed calculator 32, acceleration/deceleration determining means 33, and voltage correction coefficient setting means 34. The unit 20 further comprises constant condition determining means 35, air-fuel ratio feedback correction coefficient setting means 36, various increase correction coefficients setting means 37 and acceleration/deceleration correction coefficient setting means 38. The unit 20 further comprises learning region setting means 39, learning value setting means 40, a learning value table $T_L$, basic fuel injection quantity setting means 41, fuel injection quantity setting means 42 and a driver 43. The learning value setting means 40 comprises learning value rewriting means 40*a* and learning value deriving means 40*b*. The driver 43 outputs control signals to the injectors 8.

Figure 7:
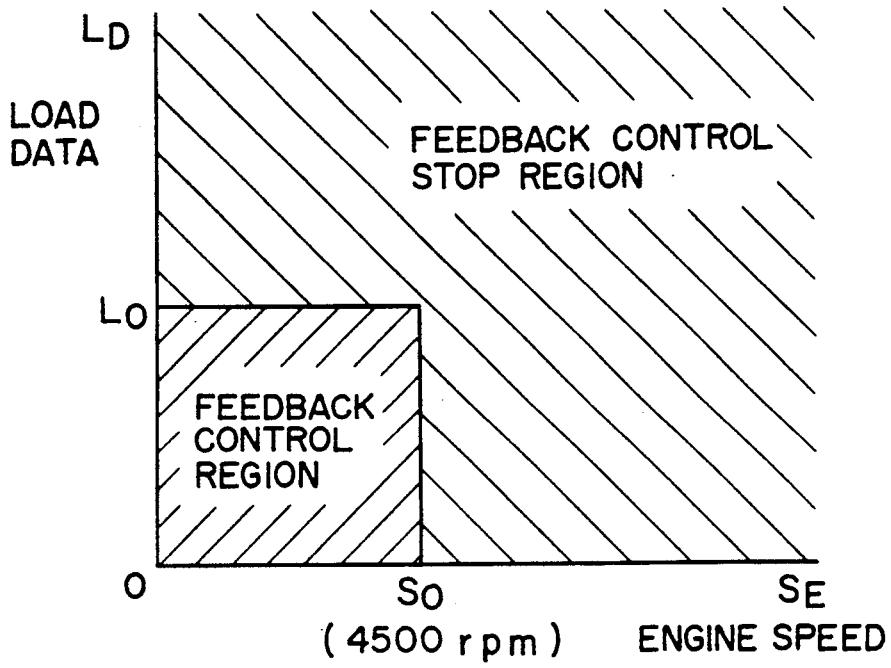
FIG. 7 is a conceptional diagram showing a feedback judgment map of the control system.

The feedback determining means 30 outputs a stop signal for stopping air-fuel ratio feedback control when the oxygen sensor 15 has a detection value in an inactive region. Though the sensor 15 detects a value in an active region, the means 30 determines whether or not an air fuel ratio feedback control condition is completed so as to instruct to the air-fuel ratio feedback correction coefficient setting means 36 whether or not the air-fuel ratio feedback control is performed. The determination as to whether the oxygen sensor 15 has the detection value in the active region or not, is carried out, for example, when the oxygen sensor 15 outputs a signal less than the set value, the inactive condition of the oxygen sensor 15 is determined. The determination for completing the air-fuel ratio feedback control condition even if the sensor 15 is put in the active condition, is performed by a feedback determination map representing an engine speed $S_E$ and an engine load data $L_D$ in dependency on a basic fuel injection quantity $T_P$ as parameters, as Shown in FIG. 7. By the map, the air-fuel ratio control stop signal is output to the correction coefficient setting means 36 when the engine speed $S_E$ is over a set speed $S_S$ for example 4,500 r.p.m.) and the load data $L_D$ is over a set load $L_S$, namely, where the engine operates in a throttle full opening region. When the engine speed $S_E$ and the load data $L_D$ are under the respective set values, and the oxygen sensor 15 is placed in the active condition, the feedback control condition is completed so that the correction coefficient setting means 36 is instructed to start air-fuel feedback control.

The suction air quantity calculator 31 and the engine speed calculator 32 respectively calculate an intake air quantity $Q_A$ and the engine speed $S_E$ in dependency on signals output from the intake air quantity sensor 13 and the crank angle sensor 11, respectively.

The acceleration/deceleration determining means 33 determines whether the engine 1 is accelerated or decelerated in dependency on a speed $d\theta/dt$ of an opening degree of the throttle valve within the predetermined time t according to a throttle opening signal $\theta$ from the throttle position sensor 12. The determining means 33 outputs an acceleration/deceleration determination signal to the acceleration/deceleration correction coefficient setting means 38.

The voltage correction coefficient setting means 34 reads out an invalid injection time (a pulse width) of the injectors 8 from a table (not shown) corresponding to a terminals voltage of the battery 16. The setting means 34 sets a voltage correction coefficient $T_S$ compensating the invalid injection time.

The constant condition determining means 35 determines a division in a matrix in dependency on the suction air quantity $Q_A$ calculated by the calculator 31 and the engine speed $S_E$ calculated by the calculator 32. The matrix is constructed by parameters of the engine speed $S_E$ and the intake air quantity $Q_A$ as shown in FIG. 4(*a*). The determining means 35 determines the engine being a constant condition when the selected division of the matrix is the same as the former selected division and the output voltage of the oxygen sensor 15 is counted n times (such as four times) in the same division.

The air-fuel ratio feedback correction coefficient setting means 36 generates an air-fuel ratio feedback control signal in dependency on the output signal from the oxygen sensor 15 when the feedback determining means determine the start of the air-fuel ratio feedback control. The setting means 36 set an air-fuel ratio feedback correction coefficient $\alpha$ corresponding to the control signal. Namely, the setting means 36 compare the output voltage of the oxygen sensor 15 with a slice level voltage and set the coefficient $\alpha$ by means of proportional (P) and integral (I) control. Accordingly, when the air-fuel ratio is rich (or lean), the control signal decreases (or increases) in a proportional (P) portion at first, then the signal slowly decreases (or increases) in an integral (I) portion so as to control the air-fuel ratio to be lean (or rich). The coefficient $\alpha$ is fixed "1" ($\alpha=1$) when the air-fuel ratio feedback control stops by determining the output of the oxygen sensor 15 being in the inactive condition or the throttle being a full opening condition.

The various increase correction coefficient setting means 37 reads a coolant temperature signal $T_C$ from the coolant temperature sensor 14, an idle signal $I_d$ from the idle switch 12*a*, and a throttle opening degree signal $\theta$ from the throttle position sensor 12, to therefore set a various increase correction coefficient $C_I$ such as a coolant correction coefficient, correction coefficient for increasing after idling, and a correction coefficient for increasing at the wide open throttle (WOT).

The acceleration/deceleration correction coefficient setting means 38 set an acceleration/deceleration correction coefficient $K_S$ directly or by a compensational calculation at accelerating or decelerating. The setting means 38 sets the coefficient $K_S$ by a map in dependency on parameters such as the engine speed $S_E$ calculated by the calculator 32 and the coolant temperature $T_C$ output from the coolant temperature sensor 14 when the determining means 33 determines the acceleration or deceleration.

The learning region setting means 39 compares a set value $Q_F$ stored in the ROM 22 with an intake air quantity $Q_A$ calculated by the calculator 31. The set value $Q_F$ is set by an experiment to the predetermined intake air quantity value in the manner that the difference of the air-fuel ratio by deterioration is influenced by the intake air quantity measurement system larger than by the fuel injection system. In the case of "$Q_A \leqq Q_F$", the setting means 39 derives a learning region of the table $T_L$ as the region learning the characteristics of the fuel injection system such as the injectors 8 and the pressure regulator 8*a* to the learning value setting means 40. In the case of "$Q_A > Q_F$", the setting means 39 derives the learning region of the table $T_L$ as the characteristics of the intake air quantity measurement system such as the intake air quantity sensor 13.

The learning table $T_L$ is constructed on the nonvolatile RAM 23*a* and has addresses $a_l$, $a_2$, $a_3$, . . . , $a_n$ corresponding to intake air quantity ranges $Q_O Q_F$, $Q_F Q_2$, $Q_2 Q_3$, . . . , $Q_{n-1} Q_n$, as shown in FIG. 4(*b*). The learning value $K_L$ is stored in every addresses al to an and has "$K_L = 10$" as the stored initial value.

The address $a_1$ in the table $T_L$ corresponding to the range is used only in a learning by the characteristics of the fuel injection system, while other addresses $a_2$ to $a_n$ are used in a learning by the characteristics of the intake air quantity measurement system.

In the learning regions directed by the region setting means 39, the learning value setting means 40 learns the representative characteristics at the specified one point corresponding to one range $Q_O Q_F$ of the table $T_L$ in accordance with the intake air quantity in the learning region of the fuel injection system, while the setting means 40 learns the characteristics of the intake air measurement system in other regions of the table $T_L$.

In the learning by the value setting means 40, the learning value rewriting means 40*a* determines the difference between the reference value and the correction coefficient $\alpha$ of the air-fuel ratio feedback set by the coefficient setting means 36 only when the determining means 35 determines the constant condition. The rewriting means 40*a* rewrites the learning value $K_L$ in the manner that the learning value $K_L$ stored in the corresponding address of the table $T_L$ is added or subtracted by the predetermined ratio in dependency on the symbol "+" or "−" of the difference from the reference value. The corresponding address has the intake air quantity range corresponding to the division of the matrix as shown in FIG. 4(*a*) specified at the determination of the constant condition by the determining means 35.

The learning value deriving means 40*b* refers to the learning value $K_L$ stored in the table $T_L$ by the intake air quantity $Q_A$ at the time point as a parameter and calculates a compensation learning correction coefficient $K_{LC}$. The coefficient $K_{LC}$ is supplied to the basic fuel injection quantity setting means 41 when the learning region by the setting means 39 corresponds to the intake air quantity measurement system. The coefficient $K_{LC}$ is supplied to the fuel injection quantity setting means 42 when the learning region by the setting means 39 corresponds to the fuel injection system. As a result, there is no difference between the basic air-fuel ratio and the theoretical air-fuel ratio "$\lambda = 1$" in dependency on the deterioration of the air measurement system or the fuel injection system, so that it is possible to improve the controllability and to cause the P and I constants of the correction coefficient $\alpha$ of the air-fuel ratio feedback to become small.

Namely, even though either the air measurement system such as the intake air quantity sensor 13 or the fuel injection system such as the pressure regulator 8*a* is deteriorated, a difference between the air-fuel ratios occurs as a result. If the control system individually learns both parameters of the both systems in the same operational region and sets the fuel injection quantity $T_i$, the parameters are respectively learned and corrected in the opposite directions because of the difference between the deterioration characteristics, for example, a parameter is corrected to the rich side while another is to the lean side, so that it is possible to improve the controllability.

Furthermore, though the actual air-fuel ratio is kept to the theoretical air-fuel ratio, the other controls such as an ignition timing control have erroneous operations because the basic fuel injection quantity $T_P$ is incorrect by the deterioration of the air measurement system in spite of the only correction of the fuel injection quantity $T_i$.

Accordingly, if the learning region is divided into the region for the air measurement system and the region for the fuel injection system, and if the learning correction is performed by the correction of the calculating error of the intake air quantity $Q_A$ and the correction of the injection quantity error of the fuel injection quantity $T_i$, it is possible to improve the calculation accuracy of the basic fuel injection quantity $T_P$ and the fuel injection quantity $T_i$ and to cause the memory region for the learning to be small The deterioration of the intake air sensor 13 is, for example, a deterioration of the detection accuracy of an air flow meter such as a hot wire type due to sticking carbon on a hot wire. As shown in FIG. 4(*c*) showing the deteriorational characteristics, the larger the intake air quantity $Q_A$, the larger the difference of the air-fuel ratio in general.

On the other hand, the deterioration of the fuel injection system is, for example, (a) the change of the response time by mechanical consumption of the injectors 8, (b) the reduction of the opening area of the injection nozzle by carbon accumulation caused by low grade fuel, (c) the change of fuel pressure according to the change of the area received pressure caused by the deterioration of a diaphragm of the pressure regulator 8*a*, or (d) the decrease of fuel pressure caused by the change of fuel pressure or the deterioration of the fuel pump 8*d*. As the deteriorational characteristics in the fuel injection system are substantially constant regardless the intake air quantity $Q_A$, it is possible to represent the learning control by only learning the specified one point in the operational region. Therefore, it is possible to minimize the memory capacity for storing the learning value. Furthermore, as the conflicting correction for the learning does not occur in dependency on the overlap of the learning regions, it is possible to improve the learning accuracy.

The basic fuel injection quantity setting means 41 calculates the basic fuel injection quantity $T_P$ in dependency on the intake air quantity $Q_A$ calculated by the air calculator 31 and the engine speed $S_E$ calculated by the engine speed calculator 32 according to an equation "$T_P = K \cdot Q_A / S_E$", where a symbol "L" means a constant. At the same time, when the deriving means 40*b* supplies a learning correction coefficient $K_{LC}$, the setting means 41 calculates the basic fuel injection quantity $T_P$ by means of the correction by the coefficient $K_{LC}$ according to an equation "$T_P = K \cdot K_{LC} \cdot Q_A / S_E$".

The fuel injection quantity setting means 42 sets a fuel injection quantity $T_i$ according to an equation as follows:

$$T_i = T_p \times \alpha \times (K_c \times K_{LC} + K_S) + T_S$$

where $T_P$ represents the basic fuel injection quantity set by the setting means 41, $\alpha$ is the correction coefficient of the air-fuel ratio feedback set by the setting means 36, $K_C$ is the correction coefficient of the air-fuel ratio set by the setting means 37, $K_{LC}$ is the learning correction coefficient supplied from the deriving means 40b, $K_S$ the acceleration/deceleration correction coefficient set by the setting means 38, and $T_S$ the voltage correction coefficient set by the setting means 34. The setting means 42 generates a driving pulse signal corresponding to the fuel injection quantity $T_i$ and outputs a signal to the injectors 8 via the driver 43 at the predetermined timing.

Next, the control procedure of the control system 20 will be described herein under, with reference to the flow charts shown in FIGS. 5 and 6.

Figure 5:
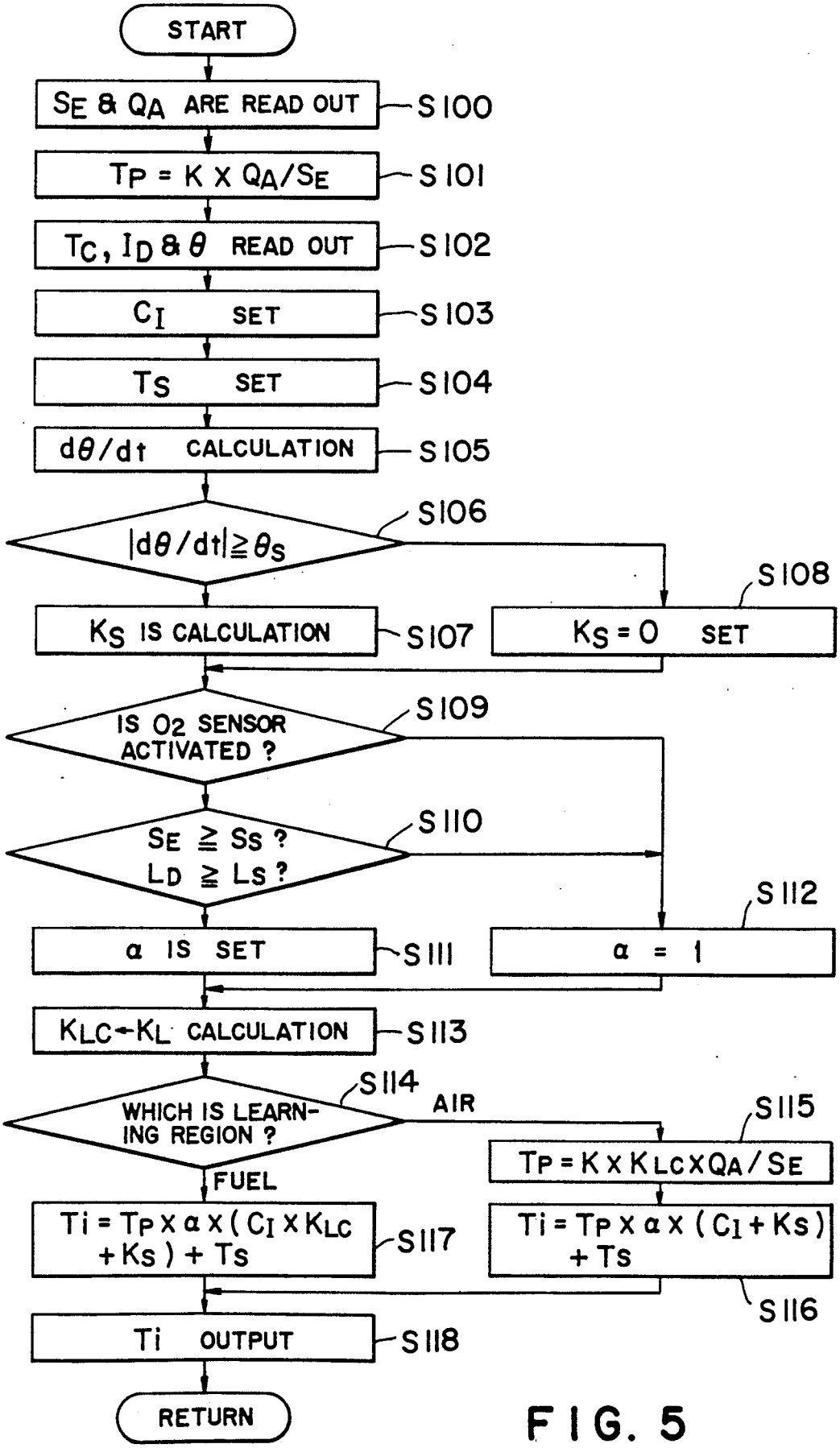
FIG. 5 is a flow chart showing the control procedure of the air-fuel ratio control system.
Figure 6:
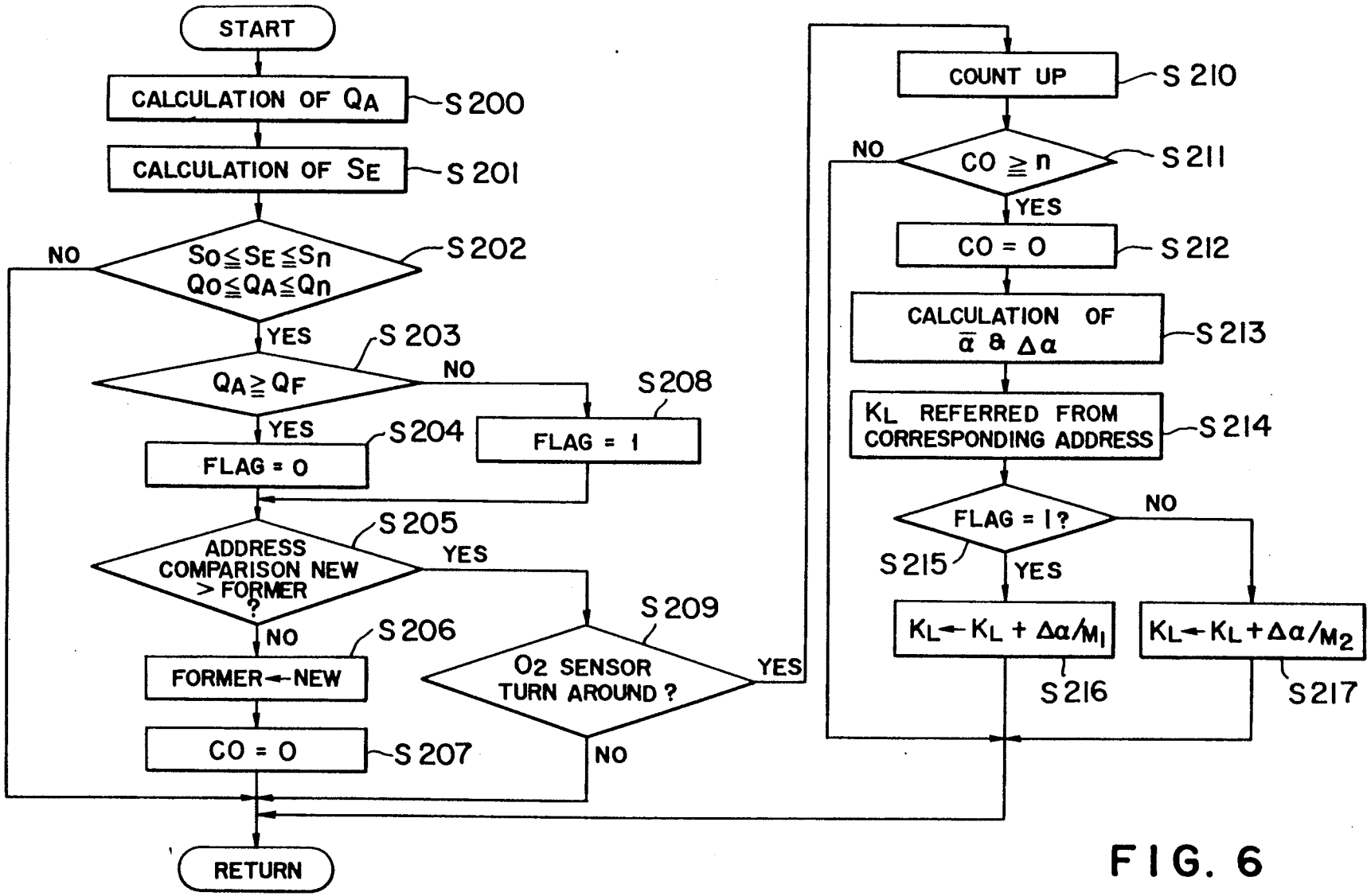
FIG. 6 is a flow chart showing a rewriting procedure of a learning value of the control system.

FIG. 5 is a flow chart showing the procedure for air-fuel control. At first, the system 20 reads signals output from the crank angle sensor 11 and the intake air quantity sensor 13 so as to calculate the engine speed $S_E$ and the intake air quantity $Q_A$ at a step S100.

At a step S101, the basic fuel injection quantity $T_P$ is calculated in dependency on the engine speed $S_E$ and the intake air quantity $Q_A$ according to the following equation $$T_p = K \times Q_A / S_E$$

where K means a constant. Then operation continues to a step S102.

At the step S102, the system 20 reads the idle 20 signal $I_d$ output from the idle switch 12a, the throttle opening degree signal $\alpha$ from the throttle position sensor 12, the coolant temperature signal $T_C$ from the coolant temperature sensor 14.

At a step S103, the system 20 calculates in dependency on the above signals so as to set various increase correction coefficients $C_I$ such as the coolant correction, increase correction after idling, increase correction by the throttle full opening.

At a step S104, the voltage correction coefficient setting means 34 sets the voltage correction coefficient $T_S$ compensating an invalid injection time of the injectors 8.

At a step S105, the acceleration/deceleration determining means 33 calculates the speed "$d\theta/dt$" of the throttle opening degree $\theta$. At a step S106, the determining means 33 determines whether the engine operates in acceleration or deceleration in dependency on the absolute value $|d\theta/dt|$ of the speed of the throttle opening degree as compared with a set value $\theta_S$.

In the case of "$|d\theta/dt| \geqq \theta_S$", operation continues to a step S107, the acceleration/deceleration correction coefficient $K_S$ for acceleration or deceleration is calculated by direct or compensated operation by means of the map showing a relation with the engine speed $S_E$ and the coolant temperature $T_C$ as parameters, then operation continues to a step S109.

On the other hand, in case of "$|d\theta/dt| < \theta_S$", the acc./dec. correction coefficient $K_S$ is set to "$K_S=0$" in the step S108, and operation go on the step S109.

The determination of acceleration or deceleration is carried out by adding or subtracting the amount "$d\theta/dt$" calculated in the step S105.

At the step S109, the system 20 compares an output (voltage) signal from the oxygen sensor 15 with a set value. When the signal is over the set value, the system 20 determines that the oxygen sensor 15 is activated and its operation continues to a step S110. On the other hand, when the signal is less than the set value, the system 20 determines that the oxygen sensor 15 is inactive because of low temperature. At a step S112, the air-fuel ratio feedback correction coefficient $\alpha$ is fixed to "$\alpha=1$", and at a step S113, the system stops the air-fuel ratio feedback control.

At the step S110, the system determines whether or not the engine is in the air-fuel ratio feedback condition by using as parameters the engine speed $S_E$ calculated at the step S100 and the engine load data $L_D$ in dependency on the basic fuel injection quantity $T_P$ set by the step S101. When the engine speed $S_E$ is less than the set speed SS (for example 4,500 r.p.m.), namely $S_E < S_S$, and the load data $L_D$ is less than the set load $L_S$ (namely $L_D < K_S$), the system determines that the condition is completed and operation goes to the step S111. On the other hand, when the engine speed $S_E$ is "$S_E \geqq S_S$" and the load data $L_D$ is "$L_D \geqq K_S$", the system determines that the operational region is at a stop region of the air-fuel ratio feedback control in the throttle substantially full open region. At a step S112, the coefficient u is fixed to "$\alpha=1$", the air-fuel ratio feedback control stops and the operation continues to the step S113 (refer to FIG. 7).

Though the determination of the oxygen sensor to be activated is performed by comparison of the output signal with the set value, the determination of the activation may be performed in the manner that the coolant temperature signal $T_C$ supplied from the coolant temperature sensor 14 is compared with the set value, if the signal $T_C$ is less than the set value (the engine condition is cool), the oxygen sensor 15 is determined to be inactivate.

Furthermore, the determination for completing the control condition of the air-fuel ratio feedback at the step S110 may be performed by the throttle full open region determination in dependency on the throttle opening degree $\theta$.

At the step S111, the output voltage from the oxygen sensor 15 is compared with the slice level so as to set the air fuel ratio feedback correction coefficient u by proportional and integral control.

At the step S113, the system 20 derives the learning value $K_L$ from the corresponding address of the learning value table $T_L$ according to the intake air quantity $Q_A$ calculated at the step S100, then the learning correction coefficient $K_{LC}$ is calculated by the compensational operation.

Next, at the step S114, the system determines whether the operational region using the intake air quantity $Q_A$ as a parameter iS in the learning region of the intake air measurement system or the fuel injection system. Namely, the system compares the intake air quantity $Q_A$ with the set value $Q_F$, and determines that the learning region is in the fuel injection system in the case of "$Q_F \geqq Q_A$", so that the operation continues to a step S117. In the case of "$Q_F < Q_A$", the system determines that the learning region is in the air measurement system so that the operation continues to a step S115.

At a step S115, when the operational region determined in the step S114 is in the learning region of the air measurement system, the basic fuel injection quantity $T_P$ set at the step S101 is corrected by the learning correction coefficient $K_{LC}$ calculated at the step S113. Namely, a calculational error of the intake air quantity caused by the deterioration of the sensors such as the intake air sensor 13 is calculated by the following equation:

$$T_P = K \times K_{LC} \times Q_A / S_E,$$

and is corrected.

At a step S116, the basic fuel injection quantity $T_i$ is set by the following equation in dependency on the corrected basic injection quantity $T_P$ and the aforementioned various correction coefficients such as various increasing quantity correction coefficients $C_I$ set at the step S103, the voltage correction coefficient $T_S$ set at the step S104, the acc./dec. correction coefficient $K_S$ set at the step S107 or the step S108, and the correction coefficient $\alpha$ for the air-fuel ratio feedback set at the step S111 or S112:

$$T_i = T_P \times \alpha \times (C_I + K_S) + T_S.$$

On the other hand, when the operational region determined in the step S114 is in the learning region of the fuel injection system, the fuel injection quantity $T_i$ is calculated by $$T_i = T_P \times \alpha \times (C_I \times KL_{LC} + K_S) + T_S$$

in order to correct the actual fuel injection quantity error caused by the deterioration of the fuel injection system such as the injector 8 at a step S117. Namely, in this case, the fuel injection quantity $T_i$ is set in dependency on the basic fuel injection quantity $T_P$ set at the step S101 and the aforementioned various coefficients.

At a step S118, a driving pulse signal corresponding to the basic fuel injection quantity $T_i$ is output to the injectors 8 through the driver 43 in the predetermined timing.

Though corrective operation is performed in the aforementioned steps, the correction for the calculational error of the intake air quantity caused by the deterioration of the intake air sensor 13 may be directly corrected by the calculation of constant K of the basic fuel injection quantity $T_P$ by the learning Correction. Furthermore, the calculation for the intake air quantity $Q_A$ in the intake air quantity setting means 31 may be performed by means of the direct correction for the intake air quantity $Q_A$.

Next, a learning value, renewal is described as follows. FIG. 6 is a flow chart showing the procedure of the learning value renewal, which is a program repeating in every predetermined time interval.

At a step S200, the intake air quantity $Q_A$ is calculated in dependency on the signal output from the intake air sensor 13. At a step S201, the engine speed $S_E$ is calculated in dependency on the signal output from the crank angle sensor 11.

At a step S202, the system respectively determines whether or not the intake air quantity $Q_A$ calculated at the step S200 is in the constant condition determined region and whether or not the engine speed $S_E$ calculated at the step S201 is in the constant condition determined region. Namely, the quantity $Q_A$ and the speed $S_E$ are respectively determined "$Q_O \leqq Q_A \leqq Q_n$" and "$S_O \leqq S_E \leqq S_n$" in a matrix region as shown in FIG. 4(*a*). If the quantity $Q_A$ and the engine speed $S_E$ are in the constant condition determined region and in a learning value renewal control range, the divisional position in the matrix is specified to a division $D_1$ in the matrix as shown in FIG. 4(*a*). If both values are in the control object range, operation continues to the step S203, and if both values are out of the control range, the routine of the system 20 ends.

At a step S203, the learning region is determined to be in any one of the air measurement system characteristics from the intake air sensor 13 or the fuel injection system characteristics from the injectors 8 by comparison of the set value $Q_F$ and the intake air quantity $Q_A$ as a parameter. If the intake air quantity $Q_A$ is over the set value $Q_F$, namely when the learning region is in the characteristics of the measurement system, an address position is specified to one of the learning value table $T_L$ corresponding to the divisional position of the matrix specified at the step S202, for example, when the division $D_1$ of the matrix is specified at the step S202, the address position of the table $T_L$ is specified a position $a_3$ correspondingly. On the other hand, if the intake air quantity $Q_A$ is less than the set value $Q_F$, namely when the learning region is in the characteristics of the fuel injection system, the address of the table $T_L$ is specified to one point, therefore the system reads out the address position data stored in the RAM 23. A flag in the system is set to "1" at step S208 and operation continues to a step S205.

As a characteristics change is substantially constant in the fuel injection system such as the injectors 8 as mentioned above, it is possible to representatively learn at one point of the intake air quantity $Q_A$ even if it has the different values in the learning region of the characteristics of the fuel injection system. Accordingly, it is possible to minimize the capacity of the learning value table $T_L$.

At a Step S204, the flag is clarified. At the step S205, the constant condition determining means 35 determines whether or not there is the constant condition by comparing the divisional position specified at this time with the position specified by the former routine in the matrix. Accordingly, when there are different positions specified by the former routine and the present routine, the determining means 35 judges the condition to be not constant and does not renew the learning value. Then, at a step S206, the divisional position in the matrix specified by the present routine is stored in the RAM 23 a the former specified divisional position data. At a step S207, the counter is clarified ($C_O=0$) and the routine ends.

Since the first routine does not have the former divisional position data, the operation jumps from the step S203 to the step S206 and the routine ends at the step S207.

On the other hand, at the step S205, when the determining means 35 judges that the divisional position in the matrix specified by the present routine is the same position by the former routine, the operation advances to a step S209. At the step S209, an output voltage of the oxygen sensor 15 is read out, and the system determines whether the output voltage alternately changes the rich or lean side.

When the voltage output from the oxygen sensor 15 does not change, the routine ends. On the contrary, when the voltage fluctuates, operation advances to a step S210 and values of the counter are counted up.

Next, at a step S211, the routine is over when the counted value in the counter is less than such as three, while the condition is determined as constant when the value is on or over n such as three, then operation continues to a step S212.

Namely, the constant condition is determined at the steps S205, S209 and S211 and the learning value is renewed if the intake air quantity $Q_A$ and the engine speed $S_E$ are substantially constant and if the voltage output from the oxygen sensor 15 changes n times. Accordingly, since the voltage output from the sensor 15 is none or very small in amount when the sensor 15 is inactive, the system determines that the voltage of the sensor 15 does not fluctuate then the routine is over so that the learning value is not renewed at the step S209.

Figure 8:
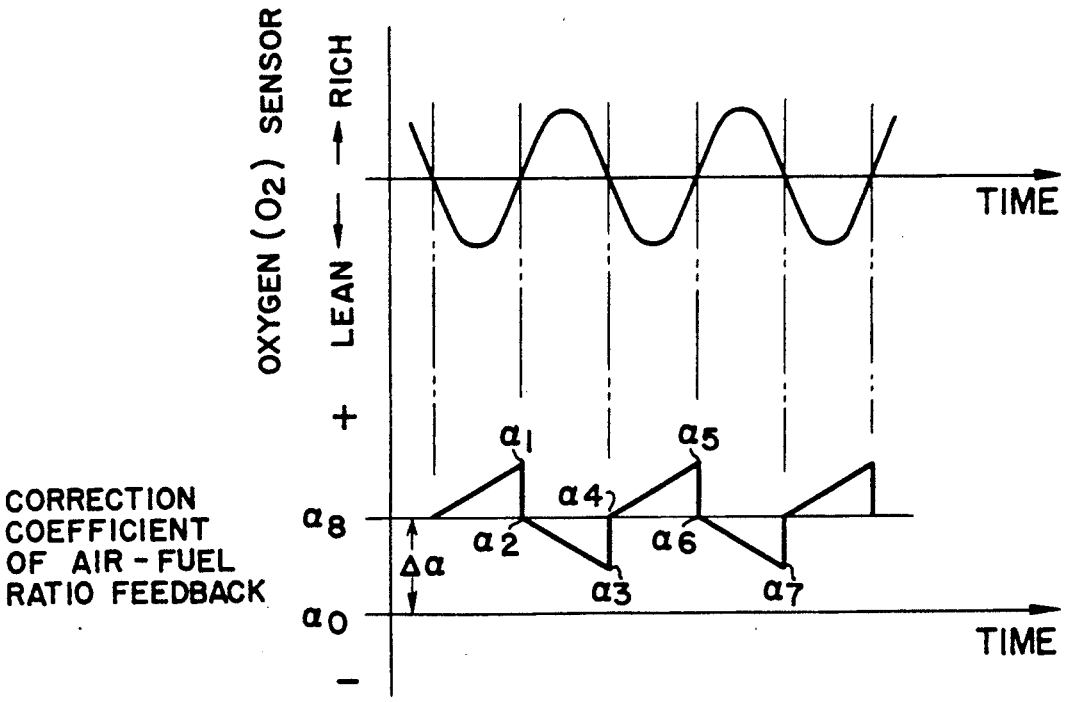
FIG. 8 is a characteristics diagram showing the relationship between a measured value of an oxygen sensor and a coefficient of a feedback correction of the air-fuel ratio.

At a step S212 after determination of the constant condition in the aforementioned steps, the counter is clarified. At a step S213, a mean value $\overline{\alpha}$ is calculated from the correction coefficient $\alpha$ for the feedback and the system calculates a difference amount $\Delta\alpha$ between the mean value $\Delta$ and a reference value $\alpha 0$. Namely, within the predetermined time interval, for example, 4 times skipping, of the air-fuel ratio feedback correction coefficient $\alpha$ generated by the setting means 36, the mean value $\overline{\alpha}$ is calculated by $$\overline{\alpha}=[(\alpha 1+\alpha 5)+(\alpha 3+\alpha 7)[/4$$

where $\alpha 1$ and $\alpha 5$ represent a maximum value and $\alpha 3$ and $\alpha 7$ represents a minimum value, respectively, and the system calculates the difference value $\Delta\alpha$ between the mean value $\overline{\alpha}$ and the reference value $\alpha 0$ (refer to FIG. 8).

At a step S214, the learning value $K_L$ is derived from the corresponding address of the learning value table $T_L$ specified at the step S203.

At a step S215, the system 20 judges whether the flag is "1" or "0". When the flag is "1", namely the learning operation is performed in the learning region of the fuel injection system, operation continues to a step S216, while when the flag is "0", namely the learning operation is in that of the air measurement system, and operation continues to a step S217.

At the step S216, a new learning value is set in dependency on the learning value $K_L$ derived at the step S214 and the difference amount $\Delta\alpha$ calculated at the step S213 according to the following equation.

$$K_L \leftarrow K_L + \Delta\alpha/M1,$$

where a coefficient Ml is predetermined value set in the ROM 22 and is a constant for determining a ratio with the difference amount $\Delta\alpha$ in dependency on the deteriorational characteristics in the fuel injection system at renewing the learning value.

On the other hand, when the learning is performed in the region of the intake air quantity measurement system, at the step S217, a new learning value is set in dependency on the learning value $K_L$ and the difference amount $\Delta\alpha$ according to the following expression:

$$K_{L \leftarrow KL}\Delta\alpha/M2$$

where a coefficient M2 is predetermined value set in the ROM 22 and is a constant for determine the ratio with the difference amount $\Delta\alpha$ in dependency on the deteriorational characteristics in the intake air measurement system at renewing the learning value.

The new learning value $K_L$ calculated at the step S216 or the step S217 renews the corresponding address value of the learning value table $T_L$ and the routine is over.

As described above in detail, the present invention is to provide the air-fuel ratio control system capable of representatively learning the characteristics of the fuel injection system at the specified one point of the operational region, and learning the characteristics of the air measurement system in other regions. Therefore, as the learning regions do not overlap between the fuel injection system and the air measurement system and as the fuel and air systems do not need to have the conflicting learning values in the same learning region, the learning operation is performed with accuracy. Furthermore, as the memory capacity of the learning values is minimized, it is possible to improve the controllability, the reformation of the exhaust emission, and the cost of fuel.

While the presently preferred embodiments of the present invention have been shown and described, it is to be understood that these disclosures are for the purpose of illustration and that various changes and modification may be made without departing from the scope of the invention as set forth in the appended claims.

What is claimed is:

1. An air-fuel ratio control system for an automotive engine, having a crank angle sensor for detecting an engine speed, an exhaust gas sensor for detecting an actual air-fuel ratio, a fuel injection system with an injector for injecting an air-fuel mixture into a combustion chamber of said engine, and an intake air quantity measurement system including an intake air quantity sensor for measuring an intake air quantity;

the control system comprising means for setting a learning region by characteristics change of said fuel injection system and said air measurement system corresponding to an operational region;

learning means for representatively learning a correction quantity of said fuel injection system at a specified point of said operational region, and for learning a correction quantity of said air measurement system in other points of said operational region in dependency on an instruction from said means for setting a learning region on the basis of the difference between a reference value of an air-fuel ratio and the actual air-fuel ratio detected by the exhaust gas sensor;

basic fuel setting means for setting a basic fuel injection quantity in dependency on the engine speed, the intake air quantity measured by said air measurement system, and a learning value from said learning means corresponding to said operational region; and fuel quality setting means for setting an actual fuel injection quantity which is corrected by said learning value corresponding to said operational region of said fuel injection system in dependency on said basic quantity.

2. The air-fuel ratio control system as set forth in claim 1; wherein said learning means comprising learning value rewriting means for rewriting said learning value in dependency on a difference ratio between a reference value and an actual value, and learning value deriving means for referring said learning value stored in a learning value table in dependency on said intake air quantity.

3. The air-fuel ratio control system as st forth in claim 1; wherein said control system comprises a central processing unit having several processing functions, a read only memory for storing fixed data and control programs, a random access memory for storing several detection values output from several sensors of said air measurement system, non-volatile memory means for storing a learning table used in said learning means in order to set said learning value corresponding to said operational region of any injection of measurement system, an input interface for receiving said several detection values from said various sensors and an idle switch provided with a throttle position sensor of the measurement system, and for receiving an output voltage from a battery via a voltage detection circuit, an output interface which is connected to said injectors provided on said cylinder, respectively, through a driver circuit, and a bus line for interconnecting said central processing unit, said read only memory, said random access memory said non-volatile memory means and input and output interfaces.

4. The air-fuel ratio control system as set forth in claim 3; wherein said central processing unit comprising feedback determining means for determining whether air-fuel ratio feedback control is stopped or not, in dependency on an oxygen density detected by said exhaust gas sensor and said engine speed, an intake air quantity calculator for calculating said intake air quantity supplied from said intake air quantity sensor of said measurement system, constant condition determining means for determining a division in a matrix of said intake air quantity stored in said learning table in said non-volatile memory means, and for outputting a region setting instruction to said learning means, and feedback correction coefficient setting means for generating an air-fuel ratio feedback control signal in dependency on a signal output from said exhaust gas sensor when said feedback determining means determines to start said air-fuel ratio feedback control.

5. An air-fuel ratio control system for an automotive engine, having a crank angle sensor for detecting an engine speed, an exhaust gas sensor for detecting an actual air-fuel ratio, a fuel injection system with an injector for injecting an air-fuel mixture into a combustion chamber of said engine, and an intake air quantity measurement system including an intake air quantity sensor for measuring an intake air quantity, the control system comprising:

first means for providing a correction quantity for said fuel injection system at a specified point of operational regions of said engine and correction quantities for said air measurement system in other points of said operational regions;

second means for correcting a fuel injection quantity by said correction quantity for said fuel injection system when a present operational region is in said specified point of said operational regions; and third means for correcting said fuel injection quantity by said correction quantities for said air measurement system when said present operational region is in said other points of said operational regions.

6. The air-fuel ratio control system as set forth in claim 5, further comprising:

fourth means for deciding said operational regions in dependency on said intake air quantity.

7. The air-fuel ratio control system as set forth in claim 5, wherein said specified point is a region of the smallest intake air quantity corresponding to characteristics f said fuel injection system.

8. The air-fuel ratio control system as set forth in claim 6, wherein said fourth means for deciding said operational regions compares said intake air quantity with a set value.

9. The air-fuel ratio control system as set forth in claim 8, wherein said fourth means for deciding said specified point of operational regions decides when a value of said intake air quantity is equal to or less than said set value.

10. The air-fuel ratio control system as set forth in claim 8, wherein said fourth means for deciding said other points of said operational regions when a value of said intake air quantity is larger than said set value.

11. The air-fuel ratio control system as set forth in claim 5 further comprising:

rewriting means for rewriting a learning value of said correction quantity and said correction quantities.

12. The air-fuel ratio control system as set forth in claim 11 further comprising:

determining means for determining a constant condition depending on said actual air-fuel ratio.

13. The air-fuel ratio control system as set forth in claim 12, wherein said rewriting means for rewriting said learning value rewrites when said determining means determines said constant condition.

* * * * *